US006810965B2

(12) United States Patent
Matsukawa et al.

(10) Patent No.: US 6,810,965 B2
(45) Date of Patent: Nov. 2, 2004

(54) METHOD AND APPLIANCE FOR EXTINGUISHING FIRE

(75) Inventors: Masao Matsukawa, Kunitachi (JP); Susumu Miyake, Kamagaya (JP)

(73) Assignees: Miyake Engineering Co., Ltd., Tokyo (JP); A.R.P. Co., Ltd., Tokyo (JP)

( * ) Notice: Subject to any disclaimer, the term of this patent is extended or adjusted under 35 U.S.C. 154(b) by 0 days.

(21) Appl. No.: 10/240,764

(22) PCT Filed: Feb. 18, 2002

(86) PCT No.: PCT/JP02/01382

§ 371 (c)(1),
(2), (4) Date: Oct. 15, 2002

(87) PCT Pub. No.: WO02/064217

PCT Pub. Date: Aug. 22, 2002

(65) Prior Publication Data

US 2003/0155133 A1 Aug. 21, 2003

(51) Int. Cl.[7] ..... A62C 2/00
(52) U.S. Cl. ..... 169/46; 239/407

(58) Field of Search ..... 169/13, 14, 15, 169/24, 46, 44; 239/407; 252/3, 8.05, 307

(56) References Cited

U.S. PATENT DOCUMENTS 5,054,688 A * 10/1991 Grindley ..... 239/407
5,085,786 A * 2/1992 Alm et al. ..... 252/8.05
5,810,089 A * 9/1998 Mack ..... 169/15

* cited by examiner

*Primary Examiner*—Michael Mar
*Assistant Examiner*—Thach H. Bui
(74) *Attorney, Agent, or Firm*—Armstrong, Kratz, Quintos, Hanson & Brooks, LLP

(57) ABSTRACT

A fire engine or a truck carrying a fire extinguishing system having a device for supplying a powder fire extinguishing agent coated with a waterproof film, e.g., a silicone resin, and a fire-fighting water delivery pipeline, is used. The powder fire extinguishing agent is added and mixed into the fire-fighting water delivery pipeline, and mixed water is delivered through a fire house and discharged from a spray nozzle provided at the distal end of the fire hose.

22 Claims, 15 Drawing Sheets

FIG. 7

Comparative data on konck-down time of water and WD (water + powder fire extinguishing agent)

| Number of times experiment | Water knock-down | WD knock-down | Nozzle type | Nozzle inlet pressure |
|---|---|---|---|---|
| First experiment | 25 | 20 | 25L/min type | 1.6kg/cm$^2$ |
| Second experiment | 17 | 9 | 25L/min type | 1.6kg/cm$^2$ |
| Third experiment | 17 | 8 | 25L/min type | 1.6kg/cm$^2$ |
| Fourth experiment | 17 | 8 | 25L/min type | 1.6kg/cm$^2$ |

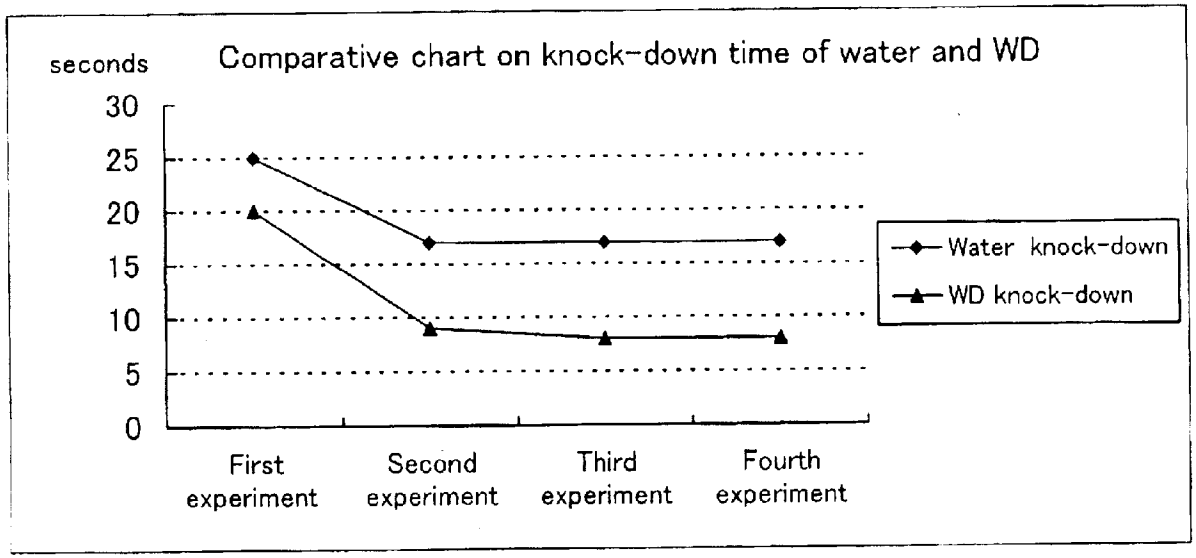

1 "WD" denotes a mixture of water and a powder fire extinguishing agent.
2 "knock-down" means a state where the flames of the burning fire have been rapidly suppressed to below the upper end of the crib.

FIG. 8

Comparative data on extinguishing time of water and WD (water + powder fire extinguishing agent)

| Number of times experiment | Water extinguishment | WD extinguishment | Nozzle type | Nozzle inlet pressure |
|---|---|---|---|---|
| First experiment | 195 | 41 | 25L/min type | 1.6kg/cm$^2$ |
| Second experiment | 150 | 28 | 25L/min type | 1.6kg/cm$^2$ |
| Third experiment | 130 | 24.5 | 25L/min type | 1.6kg/cm$^2$ |
| Fourth experiment | 130 | 24 | 25L/min type | 1.6kg/cm$^2$ |

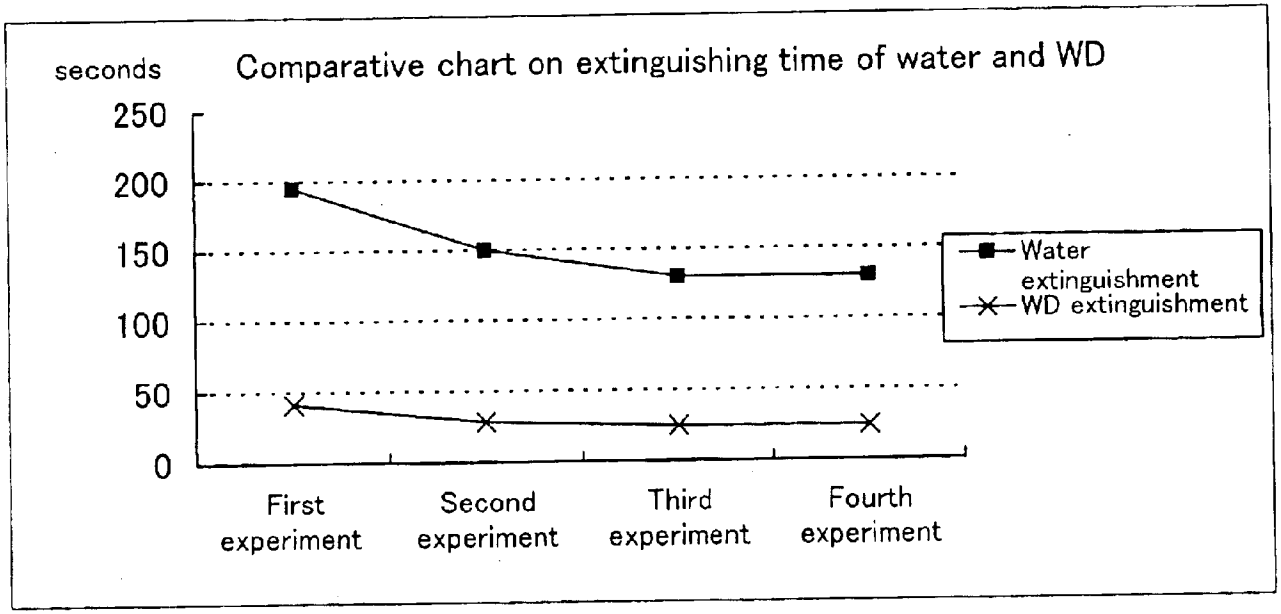

1 "WD" denotes a mixture of water and a powder fire extinguishing agent.
2 "extinguishment" means a point of time when red flames from the surface of the burning object (crib) have disappeared.

FIG. 9

Comparative data on knock-down time of aqueous film forming foam concentrate and FD

| Number of times experiment | Aqueous film forming foam concentrate | FD | Nozzle type | Nozzle inlet pressure |
|---|---|---|---|---|
| | knock-down (sec.) | knock-down (sec.) | | |
| First experiment | 56 | 46 | 17L/min type | 4.6kg/cm$^2$ |
| Second experiment | 55 | 45 | 17L/min type | 4.5kg/cm$^2$ |

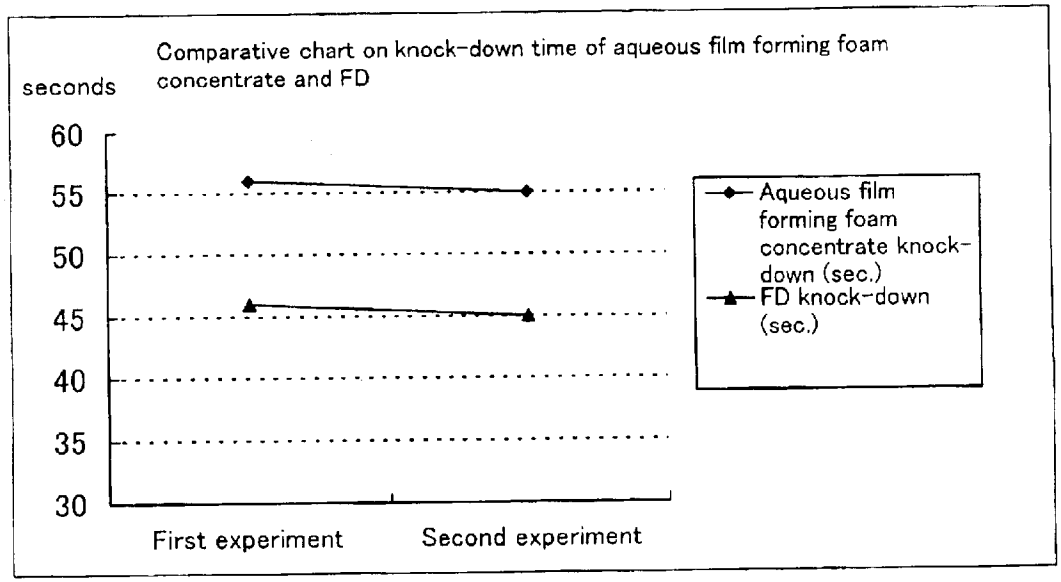

① "FD" denotes a mixture of aqueous film forming foam concentrate and a powder fire extinguishing agent ② "knock-down" means a state where flames have been suppressed to the oil surface in the oil pan.

F I G . 10

Comparative data on extinguishing time of aqueous film forming foam concentrate and FD

| Number of times experiment | Aqueous film forming foam concentrate extinguishment (sec.) | FD extinguishment (sec.) | Nozzle type | Nozzle inlet pressure |
|---|---|---|---|---|
| First experiment | 307 | 79 | 17L/min type | 4.6kg/cm$^2$ |
| Second experiment | 310 | 77 | 17L/min type | 4.5kg/cm$^2$ |

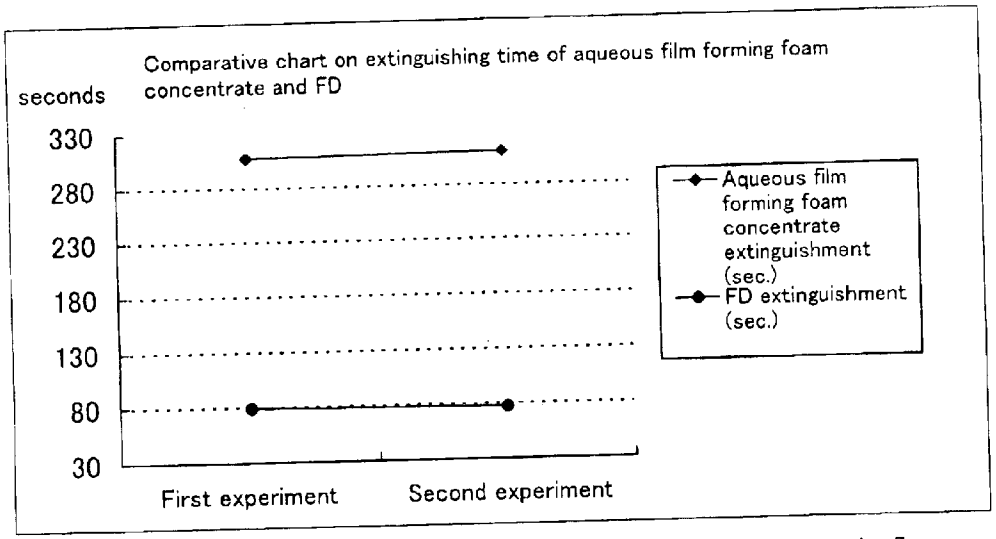

① "FD" denotes a mixture of aqueous film forming foam concentrate and a powder fire extinguishing agent.

② "extinguishment" means a state where all flames have been disappeared from the oil surface in the oil pan.

Comparative data on spray distance of water and WD

| Nozzle inlet pressure ($kg/cm^2$) | Spray distance (m) | Spray distance (m) | Spray distance (m) | Nozzle used |
|---|---|---|---|---|
| | Water | WD (first) | WD (second) | |
| 0 | 0 | 0 | 0 | 25L/min type |
| 1 | 9 | 11 | 11.5 | 25L/min type |
| 1.3 | 10 | 12 | 12.5 | 25L/min type |

Comparative data on spray distance of water and WD

| Nozzle inlet pressure ($kg/cm^2$) | Spray distance (m) | Spray distance (m) | Nozzle used |
|---|---|---|---|
| | Water | WD | |
| 0 | 0 | 0 | 100L/min type |
| 3.5 | 12 | 15 | 100L/min type |
| 4.4 | 15 | 18 | 100L/min type |

Comparative data on spray distance of aqueous film forming foam concentrate and FD

| Nozzle inlet pressure ($kg/cm^2$) | Spray distance (m) | | Nozzle used |
|---|---|---|---|
| | Aqueous film forming foam concentrate | FD | |
| 0 | 0 | 0 | 17L/min type |
| 3.5 | 11 | 13 | 17L/min type |
| 4.5 | 11.5 | 14 | 17L/min type |
| 4.6 | 11.5 | 14 | 17L/min type |

METHOD AND APPLIANCE FOR EXTINGUISHING FIRE

TECHNICAL FIELD OF THE INVENTION

The present invention relates to a fire extinguishing method and a fire extinguishing apparatus that exhibit high fire fighting efficiency. More particularly, the present invention relates to an effective fire extinguishing method and fire extinguishing apparatus using pumped water for fire fighting that has been mixed with a powder fire extinguishing agent.

BACKGROUND ART

Conventionally, a fire extinguishing method based on spraying water is generally used to extinguish ordinary house and building fires (i.e. Class A fires). In this case, however, a large amount of water is required. At the same time, it takes a great deal of time to extinguish the fire. This increases the burnt area and causes persons engaged in fire fighting, e.g. fire fighters, to be exposed to dangerous conditions for a long period of time.

It is necessary to further spray a large amount of water in order to extinguish the fire completely and to prevent the fire from restarting. This involves the problems of water damage by the large amount of water and secondary disaster damage to areas other than the fire-stricken area. When fire starts at a plurality of places that are far away from each other, the amount of water available for fire fighting may become insufficient.

Further, powder fire extinguishing agents and foam fire extinguishing agents are generally used to extinguish oil fires (i.e. Class B fires) at dangerous article manufacturing factories, berths, etc.

It is known that powder fire extinguishing agents have the action of inhibiting a fire from restarting. When sprayed on a combustible matter, particularly wood and the like of a building as an object of an ordinary fire, a powder fire extinguishing agent penetrates into the wood and forms a glassy film on heating to cover the wood surface, thereby producing a fire-restarting inhibiting effect.

It is known that a foam fire extinguishing system extinguishes a fire by the cooling effect of an aqueous solution and the smothering effect of a foam. However, a large amount of water is needed, and it takes a long period of time to suppress flames.

At present, foam fire extinguishing agents are used to extinguish most of fires in tunnels. However, foams are likely to be scattered by heated air of the fire. Accordingly, effective fire fighting cannot be performed.

DISCLOSURE OF THE INVENTION

The present invention was made to solve the above-described problems. The present invention allows epoch-making fire fighting capability to be exhibited by using pumped water for fire fighting that has been mixed with a powder fire extinguishing agent, or a combination of a powder fire extinguishing agent and a surfactant, or a combination of a powder fire extinguishing agent and a foam fire extinguishing agent in a fire-fighting water delivery pipeline.

That is, the present invention provides a fire extinguishing method and a fire extinguishing apparatus, which are arranged as follows:

(1) A fire extinguishing method characterized by using moving means carrying a fire extinguishing system, for example, a fire engine or a truck having a device for supplying a powder fire extinguishing agent and a fire-fighting water delivery pipeline; adding and mixing the powder fire extinguishing agent into the fire-fighting water delivery pipeline; delivering water mixed with the powder fire extinguishing agent through a fire hose; and discharging the mixed water from a spray nozzle provided at the distal end of the fire hose.

(2) A fire extinguishing method as stated in the above paragraph (1), which is characterized in that the moving means carrying a fire extinguishing system further has a device for supplying a surfactant stock solution or an aqueous surfactant solution.

(3) A fire extinguishing method as stated in the above paragraph (1) or (2), which is characterized in that 5 to 30 parts by weight of a powder fire extinguishing agent is added and mixed into 100 parts by weight of pumped water.

(4) A fire extinguishing method as stated in any one of the above paragraphs (1) to (3), which is characterized in that the powder fire extinguishing agent has each powder particle coated with a waterproof film.

(5) A fire extinguishing method as stated in the above paragraph (4), which is characterized in that the powder fire extinguishing agent is an ammonium phosphate-containing fire extinguishing agent powder or a potassium hydrogen-carbonate fire extinguishing agent powder, in which the surface of each particle is coated with a silicone resin.

(6) A fire extinguishing method as stated in any one of the above paragraphs (1) and (3) to (5), which is characterized in that the moving means carrying a fire extinguishing system further has a device for supplying a fire-fighting foam stock solution or an aqueous fire-fighting foam solution.

(7) A fire extinguishing method as stated in any one of the above paragraphs (1) to (6), which is characterized in that a part of the fire-fighting water delivery pipeline set on the moving means carrying a fire extinguishing system is a Venturi tube, and a powder fire extinguishing agent supply port is provided in the Venturi tube.

(8) A fire extinguishing method as stated in the above paragraph (6), which is characterized in that a part of the fire-fighting water delivery pipeline set on the moving means carrying a fire extinguishing system is a Venturi tube, and a powder fire extinguishing agent supply port and a fire-fighting foam stock solution supply port are provided in the Venturi tube.

(9) A fire extinguishing method as stated in any one of the above paragraphs (2) to (5), which is characterized in that a part of the fire-fighting water delivery pipeline set on the moving means carrying a fire extinguishing system is a Venturi tube, and a powder fire extinguishing agent supply port and a surfactant stock solution supply port are provided in the Venturi tube.

(10) A fire extinguishing method as stated in any one of the above paragraphs (1) to (9), which is characterized in that the moving means carrying a fire extinguishing system has a back carrier that a human being can carry on his or her back.

(11) A fire extinguishing method as stated in any one of the above paragraphs (1) to (10), which is characterized in that the spray nozzle has a structure in which ridges are provided on the inner wall portion of the spray nozzle at a tilt to a travel direction so that pumped water for fire fighting, a powder fire extinguishing agent, a fire-fighting foam, etc. are whirled and mixed together homogeneously.

(12) A fire extinguishing method as stated in any one of the above paragraphs (1) to (11), which is characterized in that the spray nozzle has a large number of air inlet pores in a tube wall thereof.

(13) A fire extinguishing apparatus characterized by comprising moving means carrying a fire extinguishing system, for example, a fire engine or a truck having a device for supplying a powder fire extinguishing agent and a fire-fighting water delivery pipeline; means for adding and mixing the powder fire extinguishing agent into the fire-fighting water delivery pipeline; a fire hose for delivering under pressure mixed water obtained by the means for adding and mixing the powder fire extinguishing agent; and a spray nozzle provided at the distal end of the fire hose.

(14) A fire extinguishing apparatus as stated in the above paragraph (13), which is characterized in that the moving means carrying a fire extinguishing system further has a device for supplying a surfactant stock solution or an aqueous surfactant solution.

(15) A fire extinguishing apparatus as stated in the above paragraph (13) or (14), which is characterized by having means for adding and mixing 5 to 30 parts by weight of a powder fire extinguishing agent into 100 parts by weight of pumped water.

(16) A fire extinguishing apparatus as stated in any one of the above paragraphs (13) to (15), which is characterized in that the powder fire extinguishing agent has each powder particle coated with a waterproof film.

(17) A fire extinguishing apparatus as stated in any one of the above paragraphs (13) to (15), which is characterized in that the powder fire extinguishing agent is an ammonium phosphate-containing fire extinguishing agent powder or a potassium hydrogencarbonate fire extinguishing agent powder, in which the surface of each particle is coated with a silicone resin.

(18) A fire extinguishing apparatus as stated in any one of the above paragraphs (13) and (15) to (17), which is characterized in that the moving means carrying a fire extinguishing system further has a device for supplying a fire-fighting foam stock solution or an aqueous fire-fighting foam solution.

(19) A fire extinguishing apparatus as stated in any one of the above paragraphs (13) to (18), which is characterized in that a part of the fire-fighting water delivery pipeline set on the moving means carrying a fire extinguishing system is a Venturi tube, and a powder fire extinguishing agent supply port is provided in the Venturi tube.

(20) A fire extinguishing apparatus as stated in the above paragraph (18), which is characterized in that a part of the fire-fighting water delivery pipeline set on the moving means carrying a fire extinguishing system is a Venturi tube, and a powder fire extinguishing agent supply port and a fire-fighting foam stock solution supply port are provided in the Venturi tube.

(21) A fire extinguishing apparatus as stated in the above paragraph (18) or (19), which is characterized in that a part of the fire-fighting water delivery pipeline set on the moving means carrying a fire extinguishing system is a Venturi tube, and a powder fire extinguishing agent supply port and a surfactant stock solution supply port are provided in the Venturi tube.

(22) A fire extinguishing apparatus as stated in any one of the above paragraphs (13) to (21), which is characterized in that the moving means carrying a fire extinguishing system has a back carrier that a human being can carry on his or her back.

(23) A fire extinguishing apparatus as stated in any one of the above paragraphs (13) to (22), which is characterized in that the spray nozzle has a structure in which ridges are provided on the inner wall portion of the spray nozzle at a tilt to a travel direction so that pumped water for fire fighting, a powder fire extinguishing agent, a fire-fighting foam stock solution, etc. are whirled and mixed together homogeneously.

(24) A fire extinguishing apparatus as stated in any one of the above paragraphs (13) to (23), which is characterized in that the spray nozzle has a large number of air inlet pores in a tube wall thereof.

BRIEF DESCRIPTION OF THE DRAWINGS

FIG. 7 is a graph of a test in an example.

FIG. 8 is a graph of a test in an example.

FIG. 9 is a graph of a test in an example.

FIG. 10 is a graph of a test in an example.

EXPLANATION OF REFERENCE SYMBOLS

Figure 1:
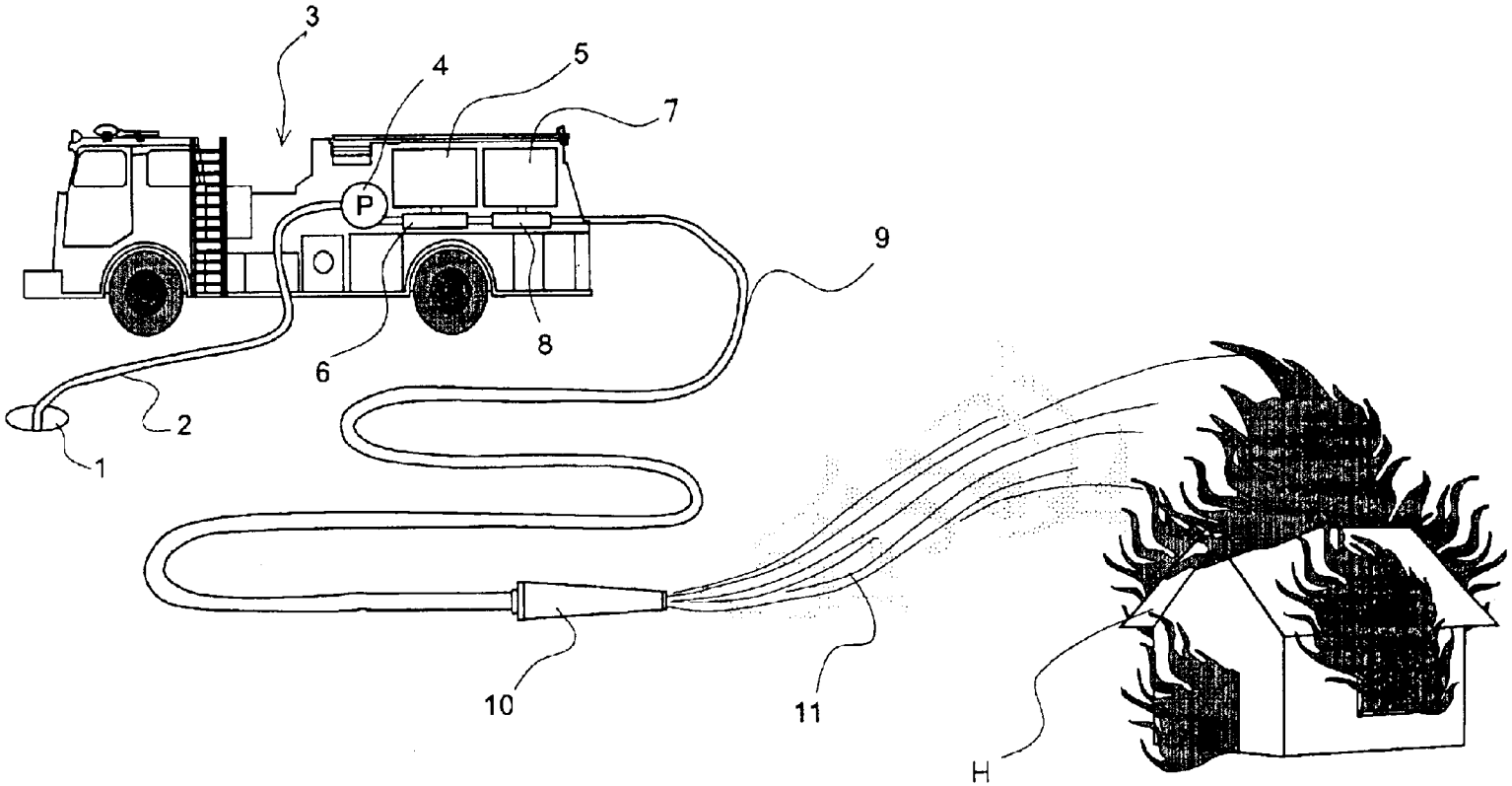
FIG. 1 is an explanatory view of a fire engine carrying a fire extinguishing system according to the present invention.

1: fire hydrant on public way
2: hose
3: fire engine
4: pump
5: surfactant container
6: surfactant proportioner
7: powder fire extinguishing agent container
8: powder fire extinguishing agent proportioner
9: fire hose
10: spray nozzle
10': air inlet ports
10*a*: spray nozzle
10*b*: spray nozzle
10*c*: spray nozzle
11: mixed solution
12: moving device, e.g. truck or wagon
13: fire-fighting water
14: powder-stirring gas cylinder
15: pipe

16: thin pipes

17: foam stock solution container

18: ridges

90: fire-fighting water delivery pipeline

100: crib

H: house

①: first pressure gauge

②: second pressure gauge

③: third pressure gauge

④: flowmeter

⑤: ball cock

⑥: sluice valve

BEST MODE FOR CARRYING OUT THE INVENTION

Embodiments of the present invention will be described below on the basis of the drawings.

FIG. 1 is an explanatory view illustrating an example of a fire extinguishing apparatus in which a fire extinguishing system according to the present invention is carried on a fire engine.

In the figure, water for fire fighting is sent from a fire hydrant (1) on a public way to a fire engine (3) through a hose (2), and the fire-fighting water is pressurized in a pump (4) on the fire engine.

Thereafter, a powder fire extinguishing agent (or together with a surfactant stock solution) is added and mixed into the pressurized water in the fire-fighting water delivery pipe in a fixed proportion from a powder fire extinguishing agent container (7) (or further from a surfactant container (5)) through a proportioner, e.g. a powder fire extinguishing agent proportioner (8) having a Venturi tube (or further through a surfactant proportioner (6)). The resulting mixed solution (11) passes through a fire hose (9) and is discharged from a spray nozzle (10) so as to be sprayed on a burning house H.

The basic technical idea of the present invention is that a powder fire extinguishing agent is added and mixed into pumped water to simultaneously apply the fire fighting action of water and the fire fighting action of the powder fire extinguishing agent, and at the same time, water (pumped water) is utilized as a carrier medium for the powder fire extinguishing agent, thereby increasing the fire fighting efficiency. Regarding the mixing proportion of the powder fire extinguishing agent, it is desirable that the powder fire extinguishing agent content should be 5 to 25% by weight with respect to a water rate of 500 to 200 L/min.

Publicly known powder fire extinguishing agents are usable in the present invention. It is particularly preferable to use a powder fire extinguishing agent containing monoammonium phosphate, potassium hydrogencarbonate or the like as a principal component. As an example, the composition of a so-called ABC powder fire extinguishing agent, which consists mainly of monoammonium phosphate ($NH_4H_2PO_4$), is shown in Table 1. That is, the powder fire extinguishing agent has a composition consisting essentially of 45 to 90% of monoammonium phosphate, not more than 45% of ammonium sulfate, and small amounts of an anti-caking agent and a water repellent, together with a trace amount of a coloring agent, as other components. It should be noted that the specific gravity of the powder is about 1.8.

TABLE 1

Powder fire extinguishing agent composition

| No. | Name of Component | Content (%) |
|---|---|---|
| 1 | monoammonium phosphate | 45 to 90 |
| 2 | ammonium sulfate | not more than 45 |
| 3 | anti-caking agent | small amount |
| 4 | water repellent | small amount |
| 5 | coloring agent | trace amount |

Working temperature range: −30° C. to +40° C.

In the present invention, it is particularly preferable to use a powder fire extinguishing agent in which the surfaces of powder particles are coated with a waterproof film, particularly a silicone resin.

It is also possible to use a mixture of a powder fire extinguishing agent and a waterproof material, e.g. paraffin or a silicone resin, or a powdered composite material obtained by crushing a bulk material that is obtained by hardening a mixture of a powder fire extinguishing agent and a silicone resin prepolymer.

If water mixed with such a powder is sprayed on flames so as to come in contact with them, the factor of "continuation of chemical reaction (chain reaction)" among the four essential factors of combustion can be satisfactorily suppressed or inhibited (negative catalytic action). In addition, because it is excellent in water-vapor resistance, the powder fire extinguishing agent will not cake by absorbing moisture in the powder fire extinguishing agent container and hence can be smoothly added and mixed into pressurized water by the proportioner. The above-described coated powder is excellent in water-vapor resistance and water resistance and will not settle in water even if it is immersed therein for a long period of time.

Further, in the present invention, an aqueous surfactant solution may be added and mixed into fire-fighting water as a wetting agent in addition to the above-described powder fire extinguishing agent. By spraying this fire-fighting water on a burning object to be extinguished, the degree of penetration of the fire-fighting water into the object to be extinguished can be increased, and thus the fire fighting capability can be improved.

A foam fire extinguishing agent may be mixed in addition to the powder fire extinguishing agent in place of the aqueous surfactant solution. Examples of foam fire extinguishing agents usable are protein foam concentrates (3% type and 6% type), fluoro-protein foam concentrates (3% type and 6% type), and aqueous film forming foam concentrates (3% type and 6% type).

Examples of the compositions of a protein foam concentrate, a fluoro-protein foam concentrate and an aqueous film forming foam concentrate are as shown in Tables 2 and 3.

TABLE 2

Protein foam concentrate composition

| Fire extinguishing agents | | Protein foam concentrate Content | Fluoro-protein foam concentrate Content |
|---|---|---|---|
| No. | Name of component | (%) | (%) |
| 1 | protein hydrolyzate | about 30 | about 30 |
| 2 | fluorine-containing synthetic surfactant | 0 | small amount |

TABLE 2-continued

| Protein foam concentrate composition | | | |
|---|---|---|---|
| Fire extinguishing agents | | Protein foam concentrate Content | Fluoro-protein foam concentrate Content |
| No. | Name of component | (%) | (%) |
| 3 | iron salt | small amount | small amount |
| 4 | foam stabilizer | small amount | small amount |
| 5 | antioxidant | small amount | small amount |
| 6 | antifreezing agent | small amount | small amount |
| 7 | preservative | small amount | small amount |
| 8 | water | balance | balance |
| Working temperature range: −10° C. to +30° C. | | | −10° C. to +30° C. |

TABLE 3

| Aqueous film forming foam concentrate composition | | |
|---|---|---|
| No. | Name of component | Content (%) |
| 1 | fluorine-containing synthetic surfactant | 100 |
| Working temperature range: −10° C. to +30° C. | | |

The above-described mixed solution of a powder fire extinguishing agent and an aqueous surfactant solution exhibits a negative catalytic effect in addition to the cooling effect and the smothering effect and is therefore capable of suppressing burning within a short period of time. A mixed solution in which the powder fire extinguishing agent content is 5% to 25% exhibits a fire fighting effect about 5 to 8 times as high as the conventional fire extinguishing method simply using water. It should be noted that when an aqueous surfactant solution is added to the mixed solution of fire-fighting water and a powder fire extinguishing agent, the mixed solution is improved in wetting-out properties and becomes capable of penetrating deep into a burning object to be extinguished. Accordingly, the fire fighting capability is further improved.

Figure 2:
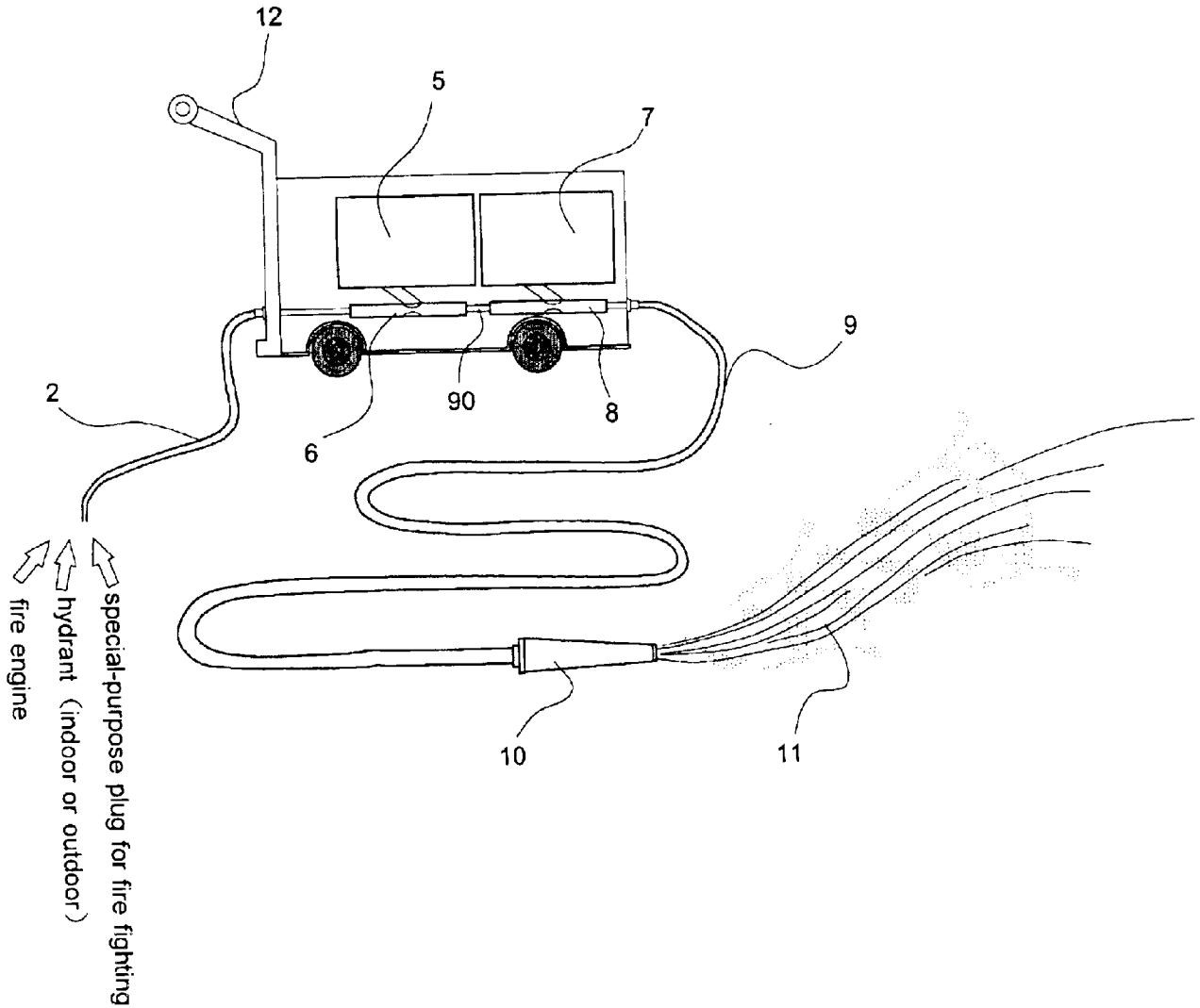
FIG. 2 is an explanatory view of a truck carrying a fire extinguishing system according to the present invention.

FIG. 2 is an explanatory view illustrating a fire extinguishing system according to the present invention that is carried on a moving device, e.g. a truck or a wagon, in place of the fire engine as shown in FIG. 1. The fire extinguishing apparatus comprises a moving device (12), e.g. a truck or a wagon, a hose (2), a surfactant container (5), a surfactant proportioner (6), a powder fire extinguishing agent container (7), a powder fire extinguishing agent proportioner (8), a fire-fighting water delivery pipeline (90), a fire hose (9), and a spray nozzle (10). The truck is towed to the site of a fire, and the surfactant proportioner (6) or the powder fire extinguishing agent proportioner (8) is connected to a fire engine or an indoor or outdoor hydrant or a special-purpose plug for fire fighting through the hose (2) to use the fire extinguishing apparatus.

In FIG. 2, the fire extinguishing apparatus may adopt an arrangement in which a surfactant is not used (i.e. the surfactant container (5) and the surfactant proportioner (6) are omitted).

It is also possible to adopt the following method: The surfactant container (5) is replaced with a foam concentrate container. Further, the spray nozzle (10) is replaced with a nozzle (FIG. 5) having foaming air inlet ports (described later). With this arrangement, a powder fire extinguishing agent and an aqueous foam solution are added and mixed into fire-fighting water, and the resulting mixed solution is sprayed in a foamed state. Fires to which this method can be suitably applied are fires in tunnels, fires at dangerous article manufacturing factories and storing places, and eruptive fires under pressure at oil piping, and so forth.

An example of use of a truck or the like carrying a powder fire extinguishing agent is as follows. When an aqueous foam concentrate solution conveying function is available at the site of a fire, including a case where a foam fire engine has been dispatched to the site, a pipe for discharging an aqueous foam solution that is provided on the foam fire engine or the like is connected to the powder fire extinguishing agent proportioner (8) of the truck (12) to spray a foam produced by mixing the powder fire extinguishing agent into the foam fire extinguishing agent, thereby performing a fire fighting operation. Mixing the powder fire extinguishing agent into the foam fire extinguishing agent makes it possible to obtain a higher fire fighting effect than the conventional fire extinguishing method using protein foam concentrate.

When a function of supplying an aqueous film forming foam concentrate solution having a dilution volume concentration of 3% or 6% is available at the site of a fire, a powder of the second kind (i.e. a powder consisting essentially of potassium hydrogencarbonate) is used in place of a powder of the third kind (i.e. a powder consisting essentially of monoammonium phosphate). By doing so, it is possible to expect a fire fighting effect about 4 times as high as the conventional fire extinguishing method using an aqueous film forming foam concentrate.

Further, the fire extinguishing system according to the present invention can be used in the form of a back-carrying type fire extinguishing apparatus. An example of use is as follows. A fire fighter goes to the site of a fire with a powder fire extinguishing agent container and a spray nozzle carried on his/her back using a back carrier, connects together the spray nozzle and the powder fire extinguishing agent container on his/her back through a connecting hose to add and mix the powder fire extinguishing agent into fire-fighting water, and discharges the mixed solution from the spray nozzle to thereby extinguish the fire.

Water sources that may be available when the fire extinguishing system is used as a back-carrying type fire extinguishing apparatus are an indoor hydrant, an outdoor hydrant, water from a fire engine, an aqueous surfactant solution, and an aqueous foam solution.

Figure 3:
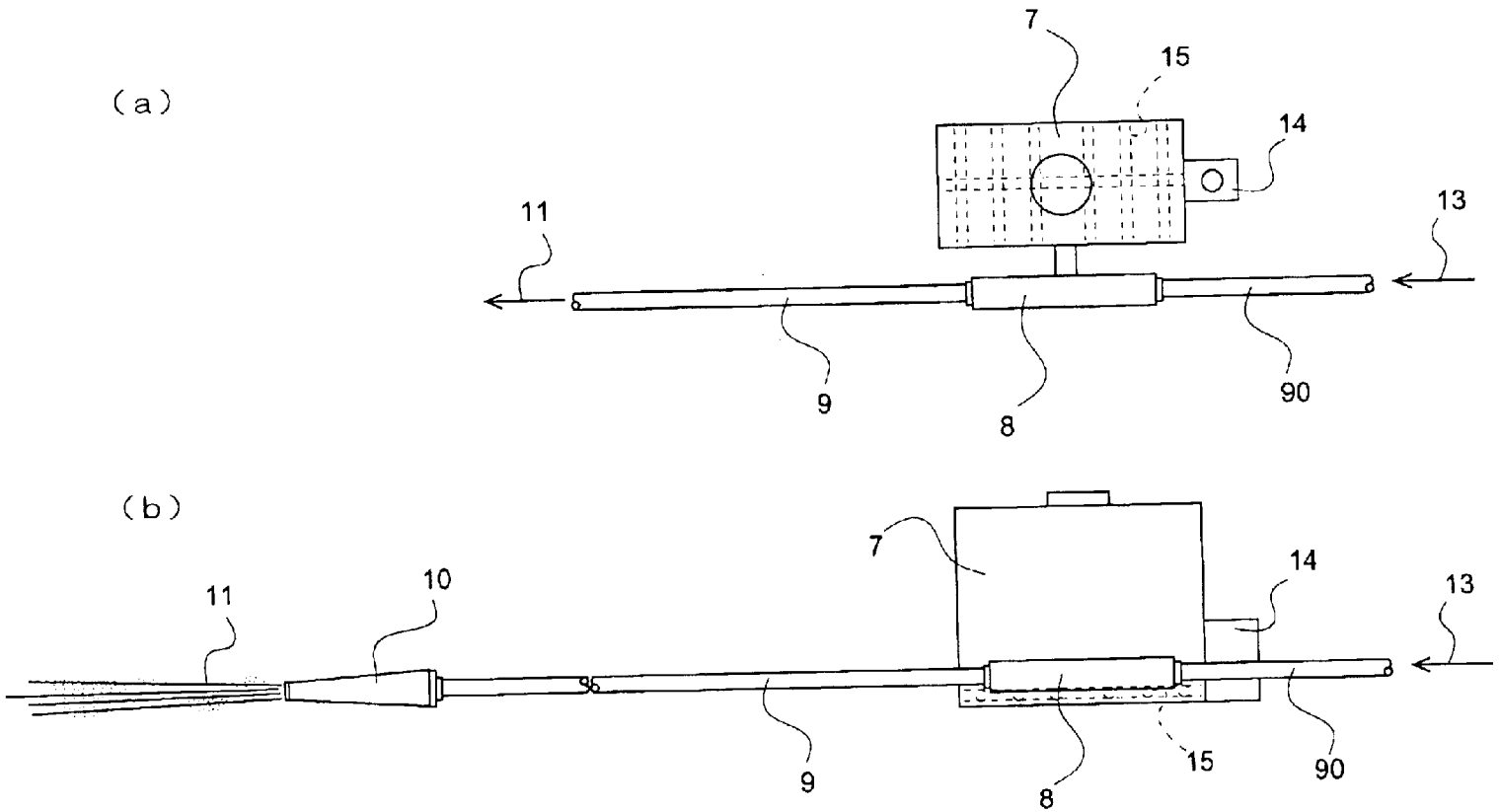
FIG. 3 shows a plan view and a front view of an apparatus for adding and mixing a powder fire extinguishing agent into pumped water for fire fighting.

FIG. 3 shows a plan view (a) and a front view (b) of an apparatus for adding and mixing a powder fire extinguishing agent into pumped water for fire fighting. A powder fire extinguishing agent deposited in a powder fire extinguishing agent container (7) is stirred and fluidized by pressurized nitrogen gas or the like blown off from the gas injection port of a powder-stirring gas cylinder (14) to pass through a pipe (15) stretched in the bottom of the powder fire extinguishing agent container (7) and having a large number of pores in the tube wall. Pressurized fire-fighting water (13) flowing through a fire-fighting water delivery pipeline (90) causes the powder fire extinguishing agent to be sucked into a powder fire extinguishing agent proportioner (8) having a Venturi tube portion from the powder fire extinguishing agent container (7) and thus proportionally mixed into the fire-fighting water (13). The mixed solution (11) passes through a fire hose (9) and is discharged from a spray nozzle (10).

Figure 4:
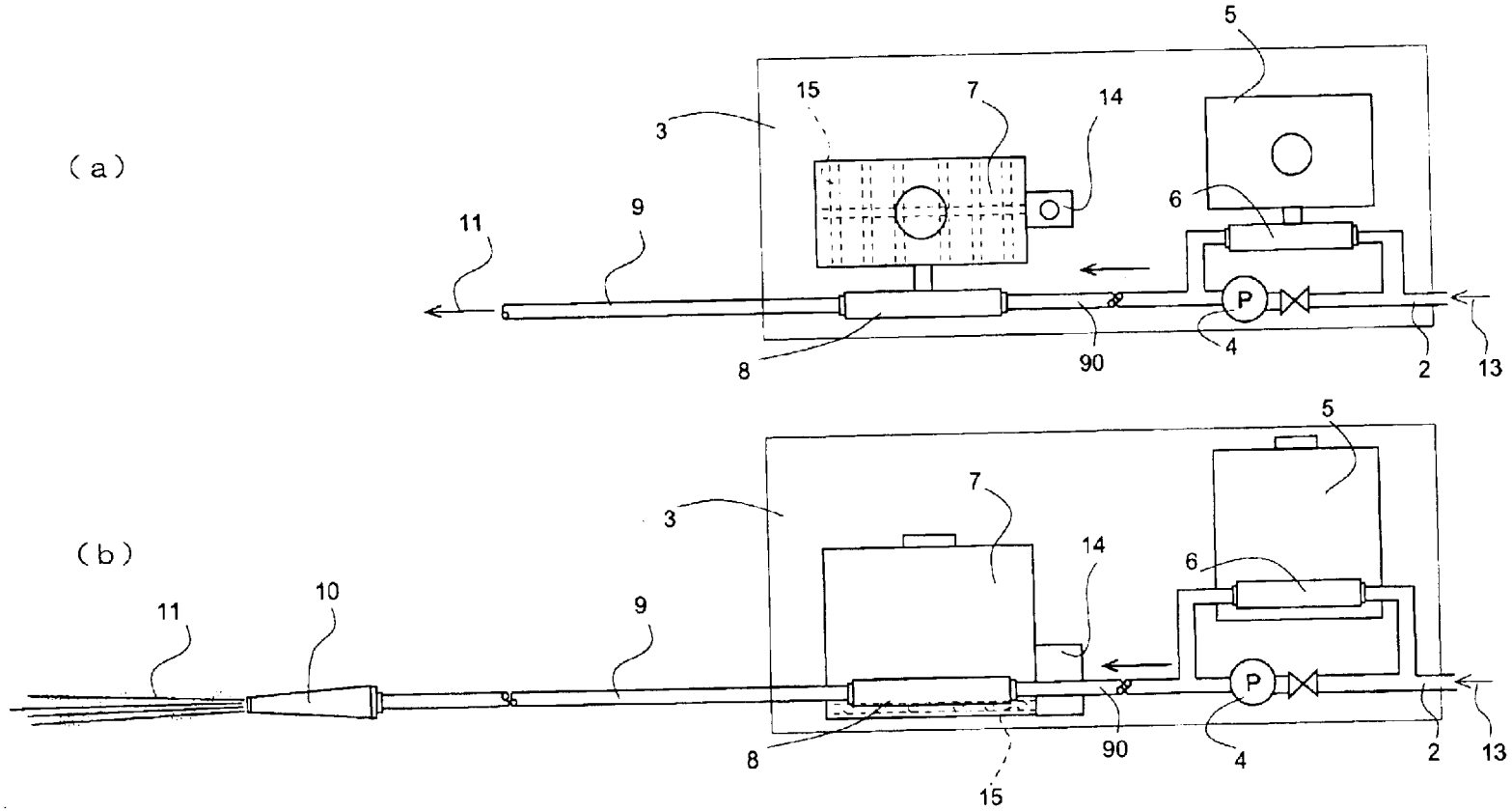
FIG. 4 shows a plan view and a front view of a fire engine carrying a surfactant container and a surfactant proportioner in addition to the apparatus shown in FIG. 3.

FIG. 4 shows a plan view (a) and a front view (b) of a fire engine carrying a surfactant container (5) and a surfactant proportioner (6) in addition to the apparatus shown in FIG. 3. A surfactant stock solution in the surfactant container (5) is sucked and added in a fixed ratio to fire-fighting water (13) flowing through the surfactant proportioner (6) by the pump proportional method. Thereafter, the surfactant stock solution is mixed with the powder fire extinguishing agent by the same mechanism as that in FIG. 3. The resulting mixed solution (11) is discharged from the spray nozzle (10).

Figure 5:
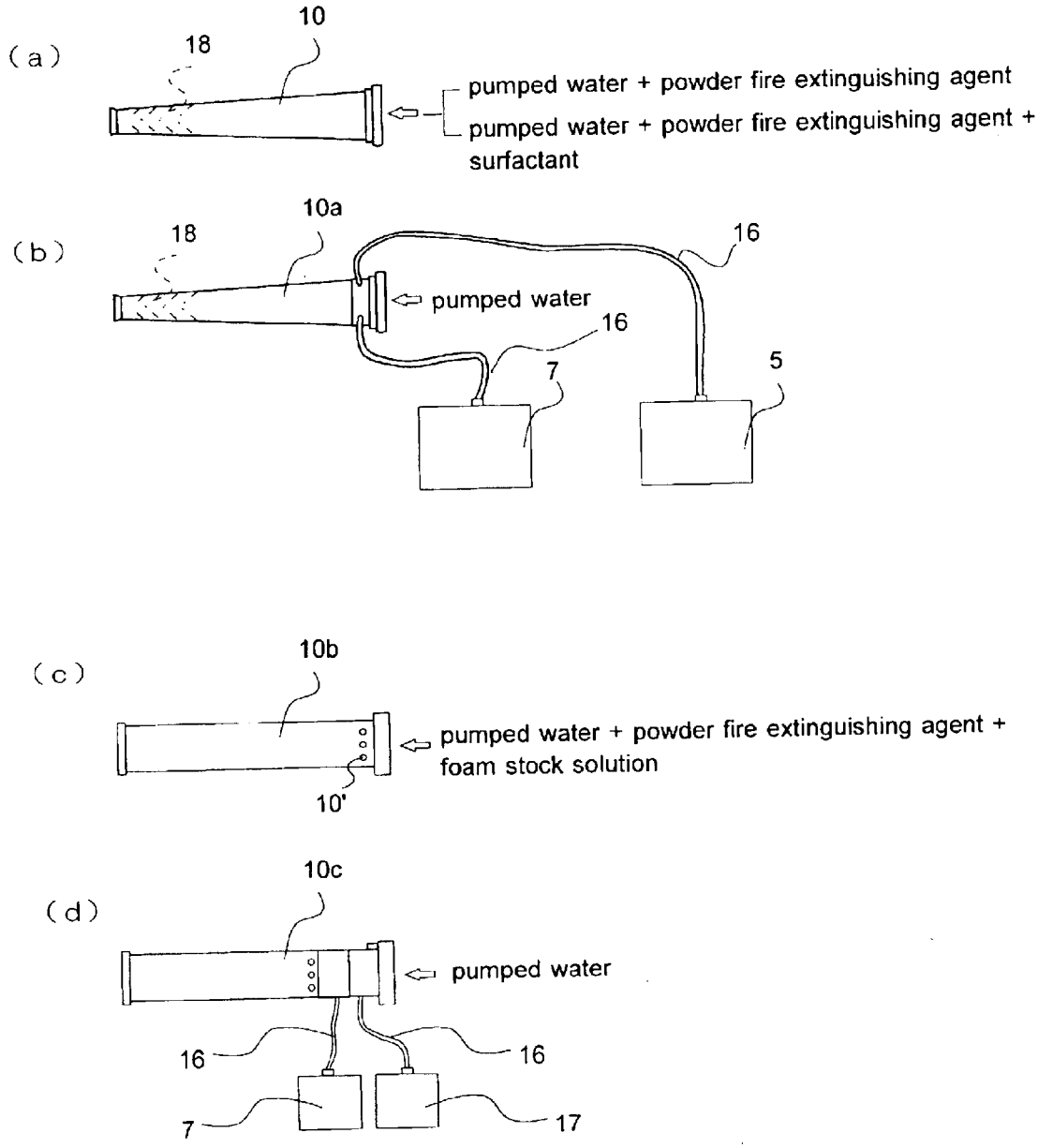
FIG. 5 is a front view of some spray nozzles usable in the present invention.

FIG. 5 is a front view of some spray nozzles usable in the present invention.

FIG. 5(*a*) shows a spray nozzle for spraying a mixed solution prepared by adding and mixing a powder fire extinguishing agent or a combination of a powder fire extinguishing agent and a surfactant stock solution into pumped water for fire fighting. That is, before pumped water for fire fighting flows into the spray nozzle (10), a powder fire extinguishing agent or a combination of a powder fire extinguishing agent and an aqueous surfactant solution is added and mixed into the fire-fighting pumped water on a moving means, e.g. a fire engine, and the resulting mixed solution is sprayed from the spray nozzle (10) through a fire hose.

In FIG. 5(*b*), only pumped water for fire fighting is allowed to flow through a fire hose or the like until it flows into a spray nozzle (10*a*). In the vicinity of the base of the spray nozzle (10*a*), a powder fire extinguishing agent or a combination of a powder fire extinguishing agent and a surfactant stock solution is added and mixed into the fire-fighting pumped water from a powder fire extinguishing agent container (7) or from the powder fire extinguishing agent container (7) and a surfactant container (5) through thin pipes (16) by the sucking action of a Venturi tube placed in the nozzle base. The resulting mixed solution is discharged from the spray nozzle (10*a*). This spray nozzle is suitable for a back-carrying type fire extinguishing apparatus used in such a manner that the powder fire extinguishing agent container (7) or the combination of the powder fire extinguishing agent container (7) and the surfactant container (5) is carried on a back carrier.

It should be noted that the spray nozzles shown in FIGS. 5(*a*) and 5(*b*) each have ridges (18) on the inner wall surface at the distal end thereof. The ridges (18) are arranged at a tilt to the travel direction of the mixed solution to allow the mixed solution to be stirred efficiently.

FIG. 5(*c*) shows a spray nozzle (10*b*) for spraying a mixed solution prepared by adding and mixing together a powder fire extinguishing agent and an aqueous foam solution on a moving means, e.g. a fire engine, before pumped water for fire fighting flows into the spray nozzle (10*b*). The tube wall surface near the base of the spray nozzle (10*b*) is provided with a plurality of air inlet ports (10') for producing a foam.

FIG. 5(*d*) shows a spray nozzle (10*c*) of the type in which only pumped water for fire fighting is allowed to flow until it flows into the spray nozzle (10*c*). In the vicinity of the base of the spray nozzle (10*c*), a powder fire extinguishing agent and a foam stock solution are added and mixed into the fire-fighting pumped water from a powder fire extinguishing agent container (7) and a foam stock solution container (17) through thin pipes (16) by the sucking action of a Venturi tube placed in the nozzle base. The resulting mixed solution is discharged from the spray nozzle (10*c*). This spray nozzle is suitable for use with a back-carrying type fire extinguishing apparatus.

The spray nozzles shown in FIGS. 5(*c*) and 5(*d*) are suitable for use to extinguish Class B fires (oil fires).

EXAMPLES

Next, examples of the present invention will be described with reference to the drawings and on the basis of data.

[Regarding Fire Extinguishing Apparatus]

Figure 6:
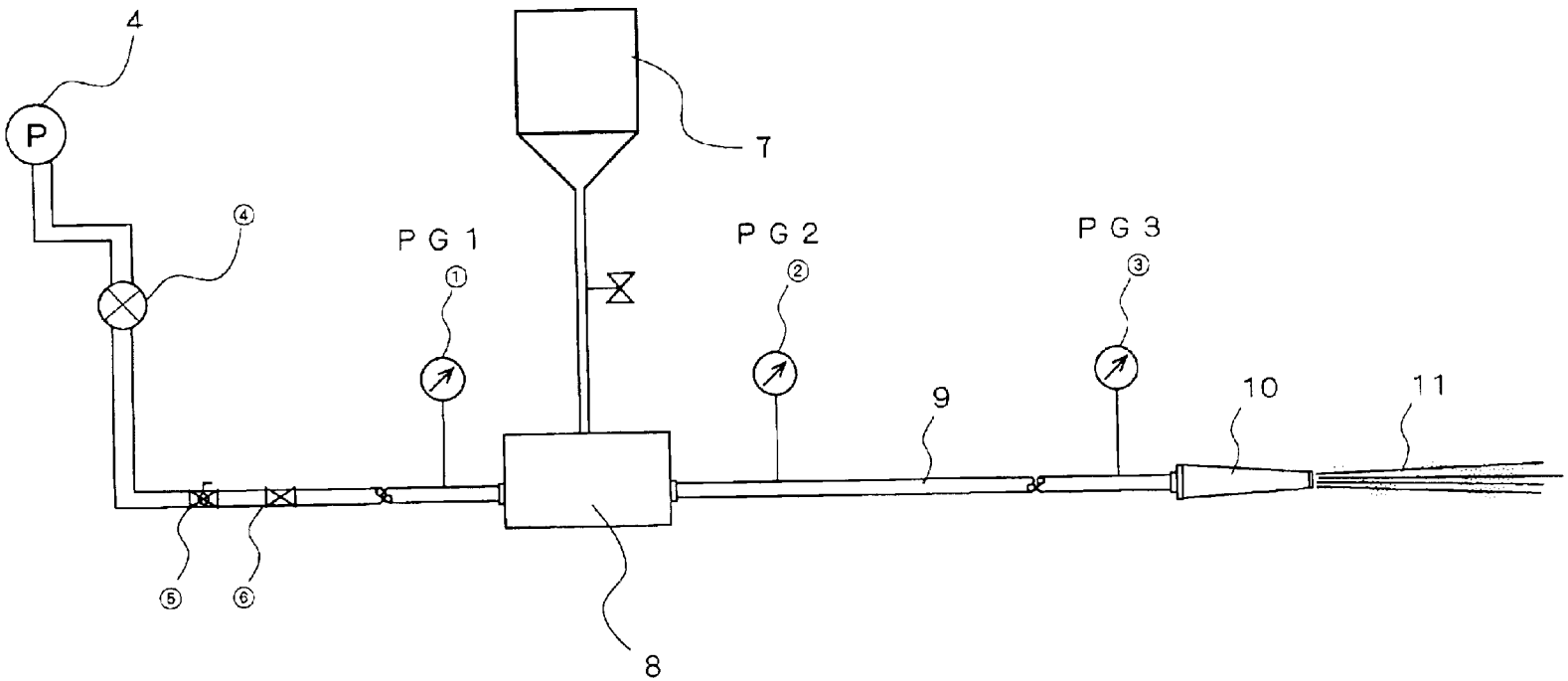
FIG. 6 is a diagram showing the arrangement of a fire extinguishing system used in a test in an example.

A fire extinguishing system as shown in FIG. 6 was employed as a fire extinguishing apparatus.

Figure 15:
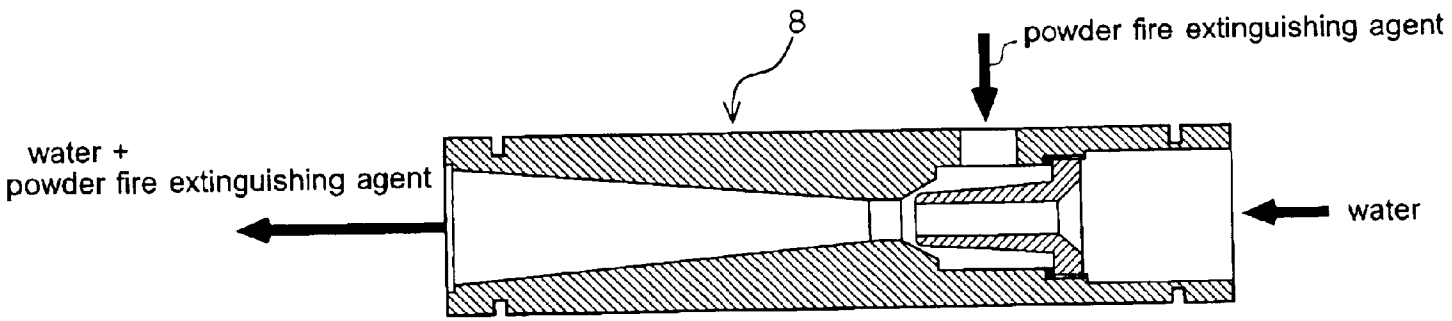
FIG. 15 is a longitudinal sectional view of a Venturi tube used in a test in an example.

That is, water delivered from a pump 4 is supplied to a proportioner 8. At the same time, a powder fire extinguishing agent is sucked from a hopper (powder fire extinguishing agent container) 7 and supplied into the pumped water by using a Venturi tube in the proportioner 8, thereby mixing the powder fire extinguishing agent into the pumped water. It should be noted that FIG. 15 shows a longitudinal sectional view of the proportioner 8 (Venturi type powder fire extinguishing agent proportioner) used in the test performed in this example.

Subsequently, the pumped water mixed with the powder fire extinguishing agent passes through a fire hose 9 and is discharged from a spray nozzle 10 as a mixed solution 11.

It should be noted that $\hat{1}$ denotes a first pressure gauge (PG1). $\hat{2}$ denotes a second pressure gauge (PG2). $\hat{3}$ denotes a third pressure gauge (PG3). $\hat{4}$ denotes a flowmeter. $\hat{5}$ denotes a ball cock. $\hat{6}$ denotes a sluice valve.

The powder fire extinguishing agent used in this experiment was a commercially available ABC powder fire extinguishing agent consisting essentially of monoammonium phosphate with a particle diameter of the order of 170 $\mu$m and having the particle surfaces coated with a thin silicone resin film.

A. Fire Extinguishing Test:

A comparison test was conducted as to the period of time required to extinguish a fire between an example of the invention of this application and an example of the prior art.

That is, a test was performed according to the conditions defined by "Article 3 of Ministerial Ordinance Defining Technical Standards for Fire Extinguishers (measurement of capability unit)" under the provision of the second paragraph of Fire Service Law Section 21(2).

A crib built of squared cedar timbers for a first fire extinguishing test was subjected to a fire extinguishing test (1) using only water (W) and a fire extinguishing test (2) using a mixed solution (WD) prepared by mixing water with a powder fire extinguishing agent (monoammonium phosphate coated with a thin silicone resin film as stated above).

Figure 14:
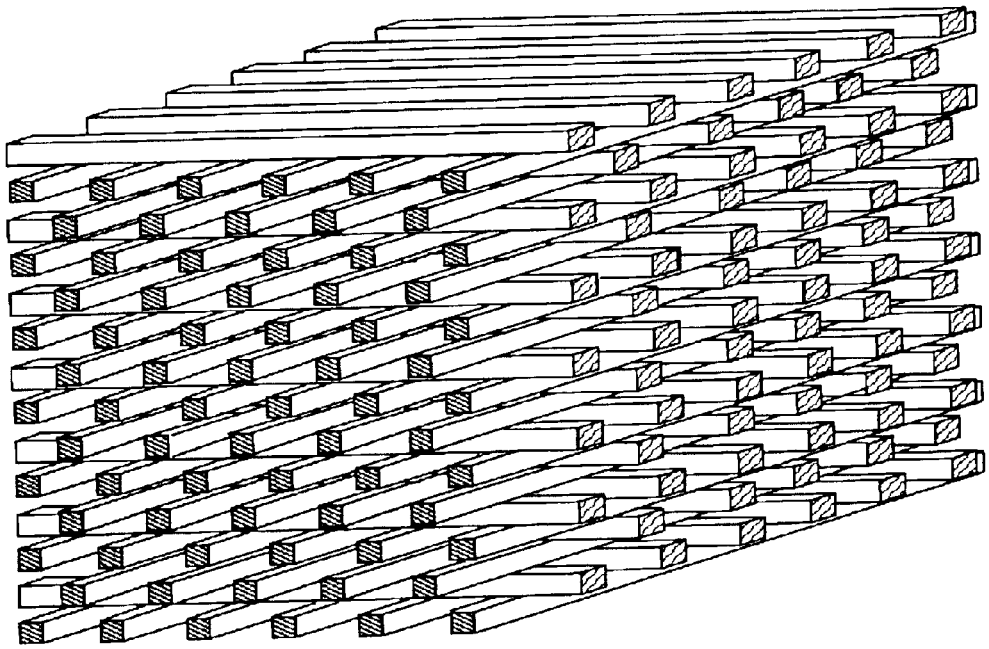
FIG. 14 is an external view of a crib used in a test in an example.

It should be noted that the crib for the first fire extinguishing test was as shown in the external view in FIG. 14, i.e. a crib (100) arranged in parallel crosses (overall surface area ≈17 $m^2$; hereinafter referred to as "first model"). That is, the crib (100) was produced as follows. 144 squared timbers of air-dried cedar (30 mm×35 mm×900 mm) were used to stack up 6 units each formed by placing a parallel-cross structure (5 timbers arranged lengthwise+5 timbers arranged breadthwise) on a parallel-cross structure (6 timbers arranged lengthwise+6 timbers arranged breadthwise). Further, a parallel-cross structure (6 timbers arranged lengthwise+6 timbers arranged breadthwise) was placed on the 6 units.

The results of the fire extinguishing test are shown in Tables 4 and 5 and FIGS. 7 and 8.

TABLE 4

| Fire extinguishing experimental conditions: | |
|---|---|
| Object burned: | Crib (structure built of squared timbers arranged in parallel crosses) First model (17 $m^2$) |
| Humidity of dried timber used: | 11 to 15% |
| Preburning time: | 3 minutes |
| Nozzle flow rate: | 25 L/min |

TABLE 4-continued

Fire extinguishing experiment record

| Items | Number of times of experiment: First experiment | Second experiment | Third experiment | Fourth experiment |
|---|---|---|---|---|
| Fire extinguishing agent | water + ABC powder | water + ABC powder | water + ABC powder | water + ABC powder |
| Amount of water used in powder intake time (20 sec.) L | 8.43 | 8.17 | 8.30 | 8.30 |
| Pressure PG1 kg/cm$^2$ | 9.0 | 9.0 | 9.0 | 9.0 |
| Pressure PG3 kg/cm$^2$ | 1.6 | 1.6 | 1.6 | 1.6 |
| Powder intake kg | 1.75 | 1.75 | 1.75 | 1.75 |
| Powder intake time SEC | 20.0 | 20.0 | 20.0 | 20.0 |
| Powder intake rate % | 17.2 | 17.6 | 17.4 | 17.4 |
| Knock-down time SEC | 20.0 | 9.0 | 8.0 | 8.0 |
| Amount of water used in knock-down time L | 8.43 | 3.68 | 3.32 | 3.32 |
| Extinguishment judging time SEC | 41.0 | 28.0 | 24.5 | 24.0 |
| Amount of water used in extinguishment judging time L | 17.28 | 11.44 | 10.17 | 9.96 |
| Restart of fire | Not restarted | Not restarted | Not restarted | Not restarted |

Knock-down . . . a state where the flames of the burning fire have been rapidly suppressed so as not to rise from the upper end of the crib.
Judgment of extinguishment . . . the fire is judged to have been extinguished when red flames from timber have disappeared.
Extinguishment judgment time . . . over the period of time during which water is sprayed to extinguish the fire.
Restart of fire . . . a state where red flames reappear within 2 minutes after water spraying has been stopped upon extinguishment judgment.
Powder intake rate % . . . powder intake (for 20 sec.) ÷ (amount of water in powder intake time + powder intake) = %.
First experiment . . . the first model was sprayed with water from one front surface thereof to extinguish the fire.
Second experiment . . . the first model was sprayed with water from two surfaces thereof to extinguish the fire (after the front surface had been sprayed with water, the right side surface was sprayed with water).
Third experiment . . . the first model was sprayed with water from three surfaces thereof to extinguish the fire (after the front surface had been sprayed with water, the right side surface was sprayed with water, and finally, the rear surface was sprayed with water).
Fourth experiment . . . conducted for reconfirmation under the same conditions as in the third experiment.

TABLE 5

Fire extinguishing experimental conditions:

| | |
|---|---|
| Object burned: | Crib (structure built of squared timbers arranged in parallel crosses) First model (17 m$^2$) |
| Humidity of dried timber used: | 11 to 15% |
| Preburning time: | 3 minutes |
| Nozzle flow rate: | 25 L/min |

Fire extinguishing experiment record

| Items | Number of times of experiment: First experiment | Second experiment | Third experiment | Fourth experiment |
|---|---|---|---|---|
| Fire extinguishing agent | water | water | water | water |
| Nozzle flow rate L/min | 25.3 | 24.6 | 24.9 | 25.0 |
| Pressure PG1 kg/cm$^2$ | 9.0 | 9.0 | 9.0 | 9.0 |
| Pressure PG3 kg/cm$^2$ | 1.6 | 1.6 | 1.6 | 1.6 |
| Powder intake kg | — | — | — | |

TABLE 5-continued

| | | | | |
|---|---|---|---|---|
| Powder intake time SEC | — | — | — | |
| Powder intake rate % | — | — | — | |
| Knock-down time SEC | 25.0 | 17.0 | 17.0 | 17.0 |
| Amount of water used in knock-down time L | 10.5 | 7.0 | 7.1 | 7.1 |
| Extinguishment judging time SEC | 195.0 | 150.0 | 130.0 | 130 (+90) |
| Amount of water used in extinguishment judging time L | 82.2 | 61.5 | 54.0 | 54.2 |
| Restart of fire | Re-started *1 | Restarted | Restarted | Not re-started *2 |

Knock-down . . . a state where the flames of the burning fire have been suppressed to below the upper end of the crib.
Judgment of extinguishment . . . the fire is judged to have been extinguished when red flames from timber have disappeared.
Restart of fire . . . a state where red flames reappear within 2 minutes after water spraying has been stopped upon extinguishment judgment.
First experiment . . . the first model was sprayed with water from one front surface thereof to extinguish the fire.
Second experiment . . . the first model was sprayed with water from two surfaces thereof to extinguish the fire (after the front surface had been sprayed with water, the right side surface was sprayed with water).
Third experiment . . . the first model was sprayed with water from three surfaces thereof to extinguish the fire (after the front surface had been sprayed with water, the right side surface was sprayed with water, and finally, the rear surface was sprayed with water).
Fourth experiment . . . conducted for reconfirmation under the same conditions as in the third experiment.
*1 . . . fire restarted 28 seconds after the above-described extinguishment judgment time (stoppage of water spraying).
*2 . . . water was additionally sprayed for 90 seconds (to prevent the fire from restarting) after the extinguishment judgment time (130 seconds) (total amount of water sprayed: 91.6 L).

In the test data shown in Table 4, water mixed with a commercially available monoammonium phosphate powder (monoammonium phosphate having a particle diameter of the order of 170 $\mu$m and coated with a thin silicone resin film) for powder extinguishers was used as a fire extinguishing agent.

It will be understood from Tables 4 and 5 and FIGS. 7 and 8 that regarding the knock-down time (i.e. the period of time required to achieve a state where the flames of the burning fire have been rapidly suppressed so as not to rise from the upper end of the crib), the fire extinguishing agent (WD) prepared by adding and mixing a powder fire extinguishing agent into water allows the knock-down time to be reduced by about 20 to 50% in comparison to the fire extinguishing agent consisting only of water. Regarding the extinguishing time, the fire extinguishing agent (WD) allows the time to be reduced to about ⅕ of the time required with the fire extinguishing agent consisting only of water. Thus, the method according to the invention of this application allows knock-down and fire extinguishment to be realized in a very short period of time.

Next, a fire extinguishing test for an oil fire (i.e. Class B fire) was performed by using a Class B fire model. It should be noted that the Class B fire model was an oil pan 2000 mm in depth, 2000 mm in width and 300 mm in height, in which 320 L of water was put, and 200 L of normal heptane was poured thereon. The fire extinguishing test was performed by using $\hat{1}$ a fire extinguishing agent consisting only of an aqueous film forming foam concentrate (a 3% aqueous solution of the aqueous film forming foam concentrate having the composition shown in Table 3) and $\hat{2}$ a mixture of an aqueous film forming foam concentrate (a 3% aqueous solution of the aqueous film forming foam concentrate having the composition shown in Table 3)+potassium bicarbonate (potassium bicarbonate having a particle diameter of the order of 140 $\mu$m and coated with a thin silicone resin film). The results of the test are shown in Table 6 and FIGS. 9 and 10.

TABLE 6

Fire extinguishing experiment record

| Items | Number of times of experiment: First experiment | Second experiment | Third experiment | Fourth experiment |
|---|---|---|---|---|
| Fire extinguishing agent | aqueous film forming foam concentrate | aqueous film forming foam concentrate + potassium bicarbonate powder | aqueous film forming foam concentrate | aqueous film forming foam concentrate + potassium bicarbonate powder |
| Amount of aqueous film forming foam concentrate solution in powder intake time (61 sec.) | | 17.3 | | 17.3 |
| Pressure PG1 kg/cm$^2$ | 11.8 | 11.8 | 11.8 | 11.8 |
| Pressure PG2 kg/cm$^2$ | 5.0 | 5.0 | 5.0 | 5.0 |
| Nozzle inlet pressure PG3 kg/cm$^2$ | 4.6 | 4.5 | 4.5 | 4.6 |
| Powder intake kg | — | 1.83 | — | 1.83 |
| Powder intake time SEC | — | 61.0 | — | 61.0 |
| Powder intake rate % | — | 9.7 | — | 9.7 |
| Knock-down time SEC | 56.0 | 46.0 | 55.0 | 45.0 |
| Amount of aqueous film forming foam concentrate solution in knock-down time | 15.9 | 13.0 | 15.6 | 13.0 |
| Extinguishment judging time SEC | 307.0 | 79.0 | 310.0 | 77.0 |
| Amount of aqueous film forming foam concentrate solution in extinguishment judging time | 87.0 | 22.4 | 87.8 | 21.8 |
| Restart of fire | Not restarted | Not restarted | Not restarted | Not restarted |
| Fire resistance of foam | OK (0 m$^3$) | OK (0 m$^3$) | OK (0 m$^3$) | OK (0 m$^3$) |

Knock-down . . . a state where flames have been suppressed to the oil surface in the oil pan.
Judgment of extinguishment . . . a state where all flames have disappeared from the oil surface in the oil pan.
Powder intake rate % . . . powder intake (for 61 sec.) ÷ (amount of aqueous film forming foam concentrate solution in powder intake time + powder intake) = %.
Reburning test . . . the Class B fire model was set on fire with a specified igniter 15 minutes after the completion of foam spraying.
Fire resistance of foam . . . the oil surface was exposed in the center of the foam surface 15 minutes after the completion of foam spraying so that the oil surface was a square 15 cm per side, and the oil was set on fire and burned for 5 minutes. When the burned area of the oil surface was not more than 900 cm$^2$, the fire resistance of foam was judged to be OK.

It will be understood from Table 6 and FIGS. 9 and 10 that regarding the knock-down time, the fire extinguishing agent (FD) prepared by adding and mixing a powder fire extinguishing agent into the aqueous film forming foam concentrate allows the knock-down time to be reduced by about 20% in comparison to the fire extinguishing agent consisting only of the aqueous film forming foam concentrate. Regarding the extinguishing time, the fire extinguishing agent (FD) allows the time to be reduced to about ¼ of the time required with the fire extinguishing agent consisting only of the aqueous film forming foam concentrate. Thus, the method according to the invention of this application allows knock-down and fire extinguishment to be realized in a very short period of time.

B. Spray Distance Comparison Test

Figure 11:
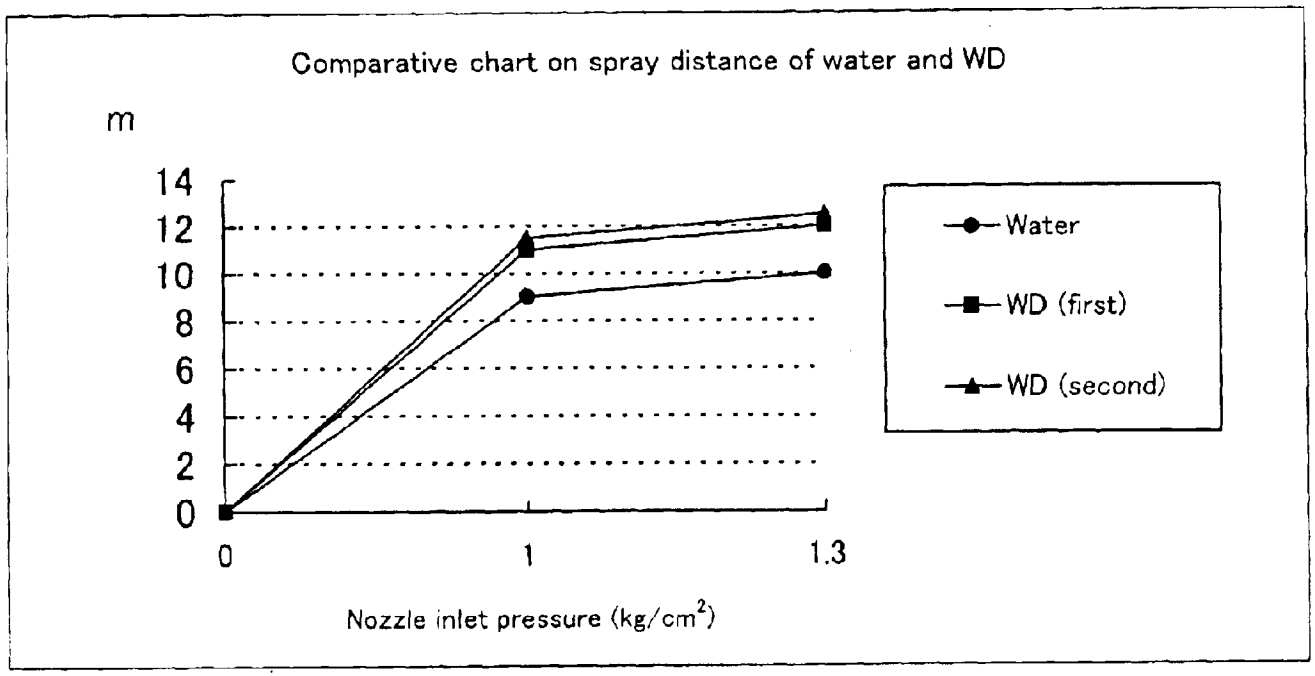
FIG. 11 is a graph of a test in an example.
Figure 12:
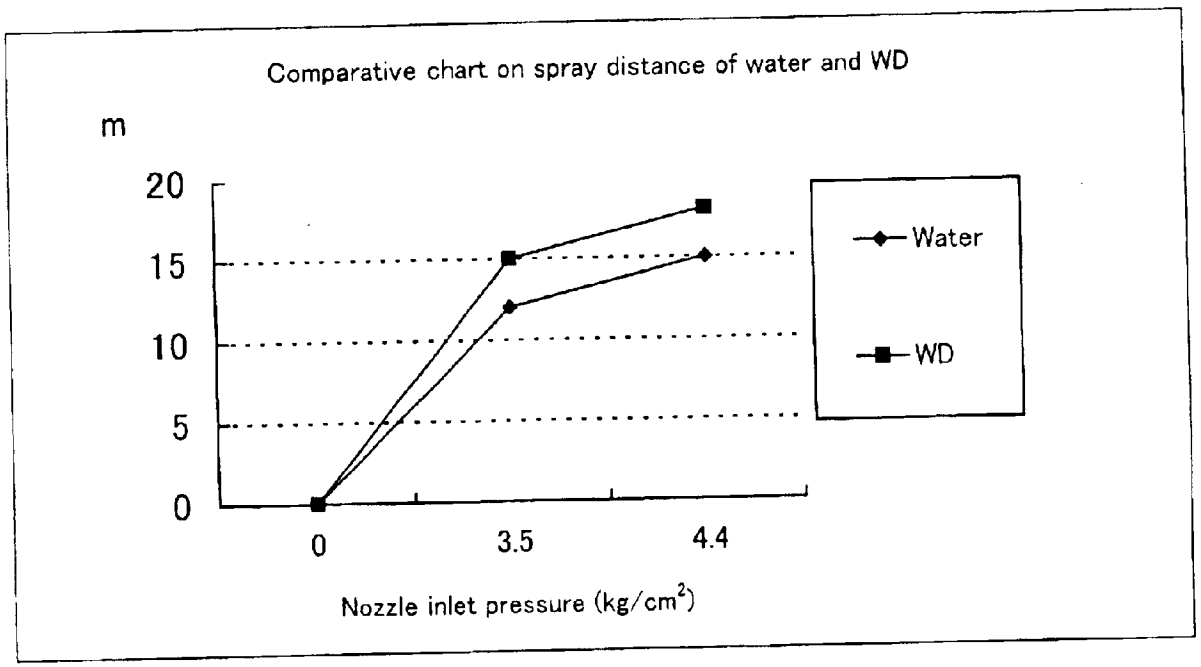
FIG. 12 is a graph of a test in an example.
Figure 13:
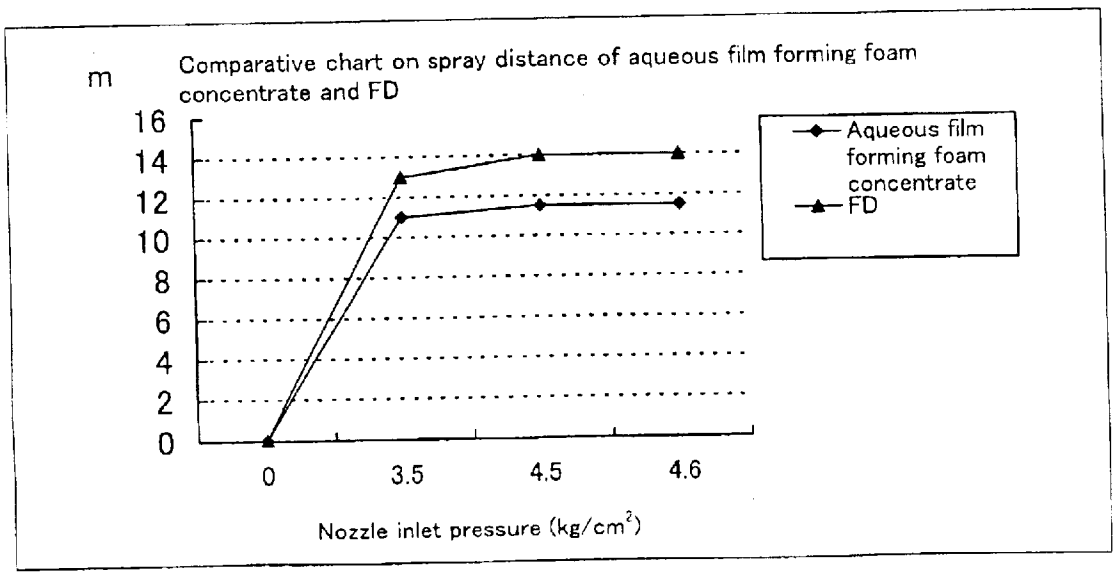
FIG. 13 is a graph of a test in an example.

A comparison test was performed as to the spray distance. The results of the test are shown in FIGS. 11 to 13.

As a result, it was revealed that the spray distance of WD or FD extends 1.2 to 1.25 times as long as that in the case of the fire extinguishing agent consisting only of water or the fire extinguishing agent consisting only of the aqueous film forming foam concentrate, although the reason for this has not yet been clarified.

INDUSTRIAL APPLICABILITY

The conventional fire extinguishing method requires a considerable time to suppress the flames of a burning fire. According to the present invention, however, the knock-down time and the extinguishing time can be markedly reduced by using a fire extinguishing apparatus having a simple system configuration. In particular, because pumped water for fire fighting is used as a carrier medium for a powder fire extinguishing agent, fire fighting using water and fire fighting using the powder fire extinguishing agent can be simultaneously carried out simply by adding the powder fire extinguishing agent to the pumped water. Thus, high-efficiency fire fighting is realized.

Furthermore, because it is possible to obtain a spray distance much longer than the spray distance available with only pumped water, the fire fighting capability can be increased.

As a result, the chance that fire fighters or the like can rescue victims of a fire is increased, by way of example. In addition, it is possible to expect significant economic effects such as a reduction in the amount of water used during fire fighting, minimization of secondary disaster damage by fire-fighting water sprayed over areas other than the fire-stricken area, a reduction in the number of fire fighters, and a reduction in the amount of machinery and materials needed for fire fighting.

What is claimed is:

1. A fire extinguishing method comprising:

using a wheeled vehicle for carrying a fire extinguishing system, the fire extinguishing system having a device for supplying a powder fire extinguishing agent and a fire-fighting water delivery pipeline;

adding and mixing said powder fire extinguishing agent into said fire-fighting water delivery pipeline;

delivering a mixture of the water mixed with said powder fire extinguishing agent through a fire hose said fire hose being attached to said water delivery pipeline; and discharging the mixture water from a spray nozzle provided at a distal end of said fire hose, wherein the powder fire extinguishing agent has each powder particle coated with a waterproof film.

2. A fire extinguishing method according to claim 1, wherein the wheeled vehicle for carrying a fire extinguishing system further has a device for supplying a surfactant stock solution or an aqueous surfactant solution.

3. A fire extinguishing method according to claim 1 or 2, wherein 5 to 30 parts by weight of a powder fire extinguishing agent is added and mixed into 100 parts by weight of pumped water.

4. A fire extinguishing method according to claim 1, wherein the powder fire extinguishing agent is a ammonium phosphate-containing fire extinguishing agent powder or a potassium hydrogencarbonate fire extinguisher agent powder, in which a surface of each particle is coated with a silicon resin.

5. A fire extinguishing method according to claim 1, wherein the wheeled vehicle for carrying a fire extinguishing system further has a device for supplying a fire-fighting foam stock solution or an aqueous fire-fighting foam solution.

6. A fire extinguishing method according to claim 1 or 2, wherein a part of the fire-fighting water delivery pipeline set on the wheeled vehicle for carrying a fire extinguishing system is a Venturi tube, and a powder fire extinguisher agent supply port is provide in said Venturi tube.

7. A fire extinguishing method according to claim 5, wherein a part of the fire-fighting water delivery pipeline set on the moving means carrying a fire extinguishing system is a Venturi tube, and a powder fire extinguishing agent supply port and a fire-fighting foam stock solution supply port are provided in said Venturi 20 tube.

8. A fire extinguishing method according to claim 2, wherein a part of the fire-fighting water delivery pipeline set on the wheeled vehicle for carrying a fire extinguishing system is a Venturi tube, and a powder fire extinguishing agent supply port and a surfactant stock solution supply port are provided in said Venturi tube.

9. A fire extinguishing method according to claim 1 or 2, wherein the wheeled vehicle for carrying a fire extinguishing system has a back carrier that a human being can carry on his or her back.

10. A fire extinguishing method according to claim 1 to 2, wherein the spray nozzle has a structure in which ridges are provided on an inner wall portion of the spray nozzle at a tilt to a travel direction so that pumped water for fire fighting, a powder fire extinguishing agent, a fire-fighting foam, etc. are whirled and mixed together homogeneously.

11. A fire extinguishing method according to claim 1 or 2, wherein the spray nozzle has a large number of air inlet pores in a tube wall thereof.

12. A fire extinguishing apparatus comprising:

wheeled vehicle for carrying a fire extinguishing system, the fire extinguishing system having a device for supplying a powder fire extinguishing agent and a fire-fighting water delivery pipeline;

means for adding and mixing said powder fire extinguishing agent into said fire-fighting water delivery pipeline;

a fire hose for delivering under pressure a mixture obtained by the means for adding and mixing said powder fire extinguishing agent with water, said fire hose being attached to said water delivery pipeline; and a spray nozzle provided at a distal end of said fire hose, wherein the power fire extinguishing agent has each powder particle coated with a water proof film.

13. A fire extinguishing apparatus according to claim 12, wherein the wheeled vehicle for carrying a extinguishing system further has a device for supplying a surfactant stock solution or an aqueous surfactant solution.

14. A fire extinguishing apparatus according to claim 12 or 13, which has means for adding and mixing 5 to 30 parts by weight of a powder fire extinguishing agent into 100 parts by weight of pumped water.

15. A fire extinguishing apparatus according to claims 12 or 13, wherein the powder fire extinguishing agent is an ammonium phosphate-containing fire extinguishing agent powder or a potassium hydrogencarbonate fire extinguisher agent powder, in which a surface of each particle is coated with a silicon resin.

16. A fire extinguisher apparatus according to claim 12, wherein the wheeled vehicle for carrying a fire extinguishing system further has a device for supplying a fire-fighting foam stock solution or an aqueous fire-fighting foam solution.

17. A fire extinguishing apparatus according to claim 12 or 13, wherein a part of the fire-fighting water delivery pipeline set on the wheeled vehicle for carrying a fire extinguisher system is a Venturi tube, and a powder fire extinguisher agent supply port is provided in said Venturi tube.

18. A fire extinguishing apparatus according to claim 16, wherein a part of the fire-fighting water delivery pipeline set on the wheeled vehicle for carrying a fire extinguishing system is a Venturi tube, and a powder fire extinguishing agent supply port and a fire-fighting foam stock solution supply port ace provided in said Venturi tube.

19. A fire extinguishing apparatus according to claim 18, wherein a part of the fire-fighting water delivery pipeline set on wheeled vehicle for carrying a fire extinguishing system is a Venturi tube, and a powder fire extinguishing agent supply port and a surfactant stock solution supply port are provided in said Venturi tube.

20. A fire extinguishing apparatus according to claim 12 or 13, wherein the wheeled vehicle for carrying a fire extinguishing system has a back carrier that a human being can carry on his or her back.

21. A fire extinguishing apparatus according to claim 12 or 13, wherein the spray nozzle has a structure in which ridges are provided on an inner wall portion of the spray nozzle at a tilt to travel direction so that pumped water for fire fighting, a powder fire extinguishing agent, a fire-fighting foam stock solution, etc. are whirled and mixed together homogeneously.

22. A fire extinguishing apparatus according to claim 12 or 13, wherein the spray nozzle has a large number of air inlet pores in a tube wall thereof.

* * * * *